US006620774B1

(12) United States Patent
Del Duca et al.

(10) Patent No.: US 6,620,774 B1
(45) Date of Patent: Sep. 16, 2003

(54) BLEACHING COMPOSITION COMPRISING SUBSTANTIALLY LINEAR NONIONIC SURFACTANTS

(75) Inventors: Valerio Del Duca, Massalubrense (IT); Andrea Esposito, Rome (IT); Milena Leone, Gallarate (IT)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/890,094

(22) PCT Filed: Jan. 20, 2000

(86) PCT No.: PCT/US00/01386

§ 371 (c)(1),
(2), (4) Date: Jul. 26, 2001

(87) PCT Pub. No.: WO00/43485

PCT Pub. Date: Jul. 27, 2000

(30) Foreign Application Priority Data

Jan. 26, 1999 (EP) ..... 99870013

(51) Int. Cl.[7] ..... C11D 3/395; C11D 1/722
(52) U.S. Cl. ..... 510/375; 510/421
(58) Field of Search ..... 510/367, 375, 510/379, 380, 381, 535, 421

(56) References Cited

FOREIGN PATENT DOCUMENTS

| | | |
|---|---|---|
| DE | 4418847 | 12/1995 |
| DE | 19612811 | 11/1996 |
| EP | 0385521 | 9/1990 |
| EP | 0598692 | 5/1994 |
| EP | 0812908 | 12/1997 |
| EP | 0825250 | 2/1998 |
| EP | 0856577 | 8/1998 |
| WO | WO 94/12600 | 6/1994 |

*Primary Examiner*—Yogendra N. Gupta
*Assistant Examiner*—John M. Petruncio
(74) *Attorney, Agent, or Firm*—Kim W. Zerby; Steven W. Miller

(57) ABSTRACT

The present invention relates to a liquid bleaching composition comprising a bleach and a substantially linear nonionic surfactant, whereby said substantially linear nonionic surfactant has the general formula: $R—(A)_x—(B)_y—(C)_z—O—R_1$ wherein: R is an even numbered $C_6$ to $C_{22}$ alkyl chain or a mixture thereof, containing at least 90% linear alkyl chains; A is an ethoxy unit; B is a butoxy unit; C is a propoxy unit; x, y and z are independent integers of from 0 to 20; the sum of x+y+z is at least 2, wherein when x is equal to or greater than 1. y+z is equal to or greater than 1; and $R_1$ is H, a $C_6$ to $C_{22}$ alkyl chain or a $C_6$ to $C_{28}$ alkyl benzene chain. Furthermore, the present invention relates to the use of said substantially linear nonionic surfactant in a fabric bleaching composition comprising a bleach to treat a fabric whereby stain removal and/or bleaching benefits are provided.

22 Claims, No Drawings

BLEACHING COMPOSITION COMPRISING SUBSTANTIALLY LINEAR NONIONIC SURFACTANTS

FIELD OF THE INVENTION

The present invention relates to bleaching compositions, which can be used to bleach various surfaces including but not limited to, fabrics, clothes, carpets and the like as well as hard-surfaces like walls, tiles, floors, glass, bathrooms surfaces, kitchen surfaces, toilet bowls and dishes.

BACKGROUND OF THE INVENTION

Bleach-containing compositions for bleaching various surfaces, e.g., fabrics, are well known in the art.

Amongst the different bleaching compositions available, those relying on bleaching by hypohalite bleach, such as hypochlorite, and those relying on peroxygen bleach, such as hydrogen peroxide, are often preferred, mainly for bleaching performance reasons.

However, a drawback associated with the use of bleach-containing compositions, e.g., peroxygen bleach-based compositions, is that there are some limitations to the convenience, especially regarding the performance, of said compositions. In particular, the stain removal performance and/or the bleaching performance of said compositions may be improved.

Bleaching compositions are often formulated comprising a surfactant or surfactant system in addition to the bleach. It is believed that surfactants are also active cleaning ingredients providing additional soil removal. Examples of compositions known in the art include bleaching compositions comprising a peroxygen bleach, an ethoxylated nonionic surfactant and a zwitterionic betaine surfactant (EP-A-0 856 576), or bleaching compositions comprising a peroxygen bleach and a nonionic surfactant system (EP-A-0 670 876).

However, there are still some limitations to the performance of said bleaches comprising nonionic surfactants. Indeed, it is well known from consumer research that the stain removal performance and/or bleaching performance of said compositions may still be further improved.

It is thus an objective of the present invention to provide a bleaching composition showing an overall improved stain removal performance on a wide range of stains while delivering excellent bleaching performance.

It has now been found that this objective can be met by a liquid bleaching composition comprising a bleach, e.g., a peroxygen bleach or a hypohalite bleach, and a substantially linear nonionic surfactant as described herein.

Indeed, it has been found that such compositions facilitate the removal of various types of stains, including greasy stains and/or enzymatic stains which are usually difficult to remove, as compared to the stain removal performance delivered by the same compositions comprising a mixed linear-branched nonionic surfactant or no surfactant. On top of this, the compositions as described herein also provide excellent bleaching performance on bleachable stains.

Advantageously, the compositions according to the present invention may be employed in various laundry bleaching applications, both when used in diluted conditions, e.g., as a detergent additive or a fully formulated laundry detergent composition, and when used in neat condition, e.g., as a liquid pretreater (spotter).

A further advantage of the compositions according to the present invention is that they can be used in a variety of conditions, i.e., in hard and soft water as well as when used neat or diluted.

Yet another advantage of the bleaching compositions of the present invention is that said bleaching compositions are also suitable for the bleaching of different types of surfaces including hard-surfaces like floors, walls, tiles, glass, kitchen surfaces, bathrooms surfaces, toilet bowls and/or dishes and the like, as well as fabrics. More particularly, the bleaching compositions of the present invention are suitable for bleaching any type of fabrics including natural fabrics (e.g., fabrics made of cotton, viscose, linen, silk and wool), synthetic fabrics, such as those made of polymeric fibers of synthetic origin, as well as those made of both natural and synthetic fibers.

BACKGROUND ART

Bleach-containing compositions based on hypochlorite bleach or peroxygen bleach suitable for bleaching surfaces, e.g., fabrics or hard-surfaces, have been described in the art.

EP-A-0 670 876 discloses bleaching composition comprising a peroxygen bleach and a nonionic surfactant system. However, compositions as described herein are not disclosed.

EP-A-0 856 576 discloses bleaching compositions comprising a peroxygen bleach, ethoxylated nonionic surfactants and zwitterionic betaine surfactants. However, compositions as described herein are not disclosed.

EP-A-0 825 250 discloses bleaching compositions comprising a bleach, e.g., a chlorine or a peroxygen bleach, and a fabric protective system. Nonionic surfactants may be present as optional ingredients. However, compositions as described herein are not disclosed.

SUMMARY OF THE INVENTION

The present invention encompasses a liquid bleaching composition comprising a bleach and a substantially linear nonionic surfactant, whereby said substantially linear nonionic surfactant has the general formula: $R—(A)_x—(B)_y—(C)_z—O—R_1$ wherein: R is an even numbered $C_6$ to $C_{22}$ alkyl chain or a mixture thereof, containing at least 90% linear alkyl chains; A is an ethoxy unit; B is a butoxy unit; C is a propoxy unit; x, y and z are independent integers of from 0 to 20; the sum of x+y+z is at least 1; and $R_1$ is H, a $C_6$ to $C_{22}$ alkyl chain or a $C_6$ to $C_{28}$ alkyl benzene chain.

In a preferred embodiment of the present invention said bleach is a peroxygen bleach or a hypohalite bleach or a mixture thereof.

In another preferred embodiment according to the present invention said composition further comprises other surfactants on top of the nonionic surfactants as described herein.

The present invention also encompasses a process of bleaching surfaces, e.g., fabrics, wherein said surfaces are contacted with a bleaching composition as defined herein.

The present invention further encompasses the use of a substantially linear nonionic surfactant having the general formula $R—(A)_x—(B)_y—(C)_z—O—R_1$ wherein: R is an even numbered $C_6$ to $C_{22}$ alkyl chain or a mixture thereof, containing at least 90% linear alkyl chains; A is an ethoxy unit; B is a butoxy unit; C is a propoxy unit; x, y and z are independent integers of from 0 to 20; the sum of x+y+z is at least 1; and $R_1$ is H, a $C_6$ to $C_{22}$ alkyl chain or a $C_6$ to $C_{28}$ alkyl benzene chain; in a fabric bleaching composition comprising a bleach to treat a fabric whereby stain removal and/or bleaching benefits are provided.

DETAILED DESCRIPTION OF THE INVENTION

The Bleaching Composition

The compositions according to the present invention are liquid compositions as opposed to a solid or a gas. As used herein"liquid" includes compositions in gel and paste form.

Accordingly, preferred compositions of the present invention have a viscosity of 1 cps or greater, more preferably of from 10 to 5000 cps, and still more preferably of from 10 to 2500 cps at 20° C. when measured with a $CSL^2$ 100® Rheometer at 20° C. with a 4 cm spindle (linear increment from 10 to 100 dyne/$cm^2$ in 2 minutes).

The bleaching compositions according to the present invention are preferably, but not necessarily formulated as aqueous compositions. A preferred liquid bleaching composition of the present invention is aqueous and therefore, preferably comprises water in an amount of from 60% to 98%. more preferably of from 70% to 97% and most preferably 75% to 97% by weight of the total composition.

Bleach

As a first essential ingredient, the compositions of the present invention comprise a bleach. Any bleach known to those skilled in the art may be suitable for use herein. Preferred bleaches include any peroxygen bleach, as well as any hypohalite bleach.

The presence of a bleach, preferably a peroxygen bleach or a hypohalite bleach, contributes to the excellent bleaching benefits of the bleaching compositions herein.

Suitable peroxygen bleaches to be used herein are selected from the group consisting of: hydrogen peroxide; water soluble sources of hydrogen peroxide; organic or inorganic peracids; hydroperoxides; diacyl peroxides; and mixtures thereof.

As used herein a hydrogen peroxide source refers to any compound that produces perhydroxyl ions on contact with water. Suitable water-soluble sources of hydrogen peroxide for use herein include percarbonates, perborates and persilicates and mixtures thereof.

Suitable diacyl peroxides for use herein include aliphatic, aromatic and aliphatic-aromatic diacyl peroxides, and mixtures thereof.

Suitable aliphatic diacyl peroxides for use herein are dilauroyl peroxide, didecanoyl peroxide, dimyristoyl peroxide, or mixtures thereof. A suitable aromatic diacyi peroxide for use herein is for example benzoyl peroxide. A suitable aliphatic-aromatic diacyl peroxide for use herein is for example lauroyl benzoyl peroxide. Such diacyl peroxides have the advantage of being particularly safe to fabrics and color while delivering excellent bleaching performance when used in any laundry application.

Suitable organic or inorganic peracids for use herein include persulphates such as monopersulfate; peroxyacids such as diperoxydodecandioic acid (DPDA); magnesium perphthalic acid; perlauric acid; phthaloyl amidoperoxy caproic acid (PAP); perbenzoic and alkylperbenzoic acids; and mixtures thereof.

Suitable hydroperoxides for use herein are tert-butyl hydroperoxide, cumyl hydroperoxide, 2,4,4-trimethylpentyl-2-hydroperoxide, di-isopropylbenzene-monohydroperoxide, tert-amyl hydroperoxide and 2,5-dimethyl-hexane-2,5-dihydroperoxide and mixtures thereof. Such hydroperoxides have the advantage of being particularly safe to fabrics and color while delivering excellent bleaching performance when used in any laundry application.

Preferred peroxygen bleaches herein are selected from the group consisting of: hydrogen peroxide; water soluble sources of hydrogen peroxide; organic or inorganic peracids; hydroperoxides; and diacyl peroxides; and mixtures thereof. More preferred peroxygen bleaches herein are selected from the group consisting of hydrogen peroxide and diacyl peroxides and mixtures thereof. Even more preferred peroxygen bleaches herein are selected from the group consisting of hydrogen peroxide, aliphatic diacyl peroxides, aromatic diacyl peroxides and aliphatic-aromatic diacyl peroxides and mixtures thereof.

Preferably, the compositions herein may comprise from 0.01% to 30%, preferably from 0.3% to 20%, more preferably from 0.5% to 15%, even more preferably from 1.5% to 10%, and most preferably from 2% to 10% by weight of the total composition of said peroxygen bleach or a mixture thereof.

Suitable hypohalite bleaches may be provided by a variety of sources, including bleaches that lead to the formation of positive halide ions and/or hypohalite ions, as well as bleaches that are organic based sources of halides, such as chloroisocyanurates.

Suitable hypohalite bleaches for use herein include the alkali metal and alkaline earth metal hypochlorites, hypobromites, hypoiodites, chlorinated trisodium phosphate dodecahydrates, potassium and sodium dichloroisocyanurates, potassium and sodium trichlorocyanurates, N-chloroimides, N-chloroamides, N-chloroamines and chlorohydantoins.

For the bleaching compositions, the preferred hypohalite bleaches among the above described are the alkali metal and/or alkaline earth metal hypochlorites selected from the group consisting of sodium, potassium, magnesium, lithium and calcium hypochlorites, and mixtures thereof, more preferably the alkali metal sodium hypochlorite.

Preferably, the liquid compositions according to the present invention comprise said hypohalite bleach such that the content of active halide in the composition is of from 0.01% to 20% by weight, more preferably from 0.1% to 10% by weight, even more preferably from 0.5% to 6% and most preferably from 1% to 6% by weight of the composition.

pH

The pH of the bleaching compositions as described herein may be from 0 to 14.

In an embodiment, wherein the bleaching compositions herein comprise a hypohalite bleach, typically an alkali metal hypochlorite, the recommended pH range of the bleaching composition is from 8 to 14, preferably 8.5 to 14, more preferably from 9 to 13.5, and even more preferably from 9.5 to 13.5. It is in this alkaline pH range that the optimum stability and performance of the hypohalite bleach, e.g., hypochlorite, is obtained.

If appropriate, the compositions of the present invention may comprise an alkalinity source to adjust the pH of said compositions. The bleaching compositions herein may comprise up to 10%, preferably of from 0.04% to 5% and more preferably of from 0.1% to 2% by weight of the total composition of said alkalinity source.

Suitable alkalinity sources for use herein are the caustic alkalis, such as sodium hydroxide, potassium hydroxide and/or lithium hydroxide, and/or the alkali metal oxides such, as sodium and/or potassium oxide or mixtures thereof. A preferred alkalinity source is a caustic alkali, more preferably sodium hydroxide and/or potassium hydroxide.

Other suitable alkalinity sources include ammonia, ammonium carbonate and hydrogen carbonate.

In an alternative embodiment, wherein the bleaching compositions herein comprise a peroxygen bleach, the recommended pH range of the bleaching composition to achieve good stability is from 1 to 9, preferably between pH 1 and 8, more preferably between pH 1 and 7 and most preferably between pH 1 and 6.

If appropriate, the bleaching compositions herein may further comprise an acid to adjust pH of said compositions. The bleaching compositions of the present invention may comprise up to 10%, preferably of from 0.04% to 5% and more preferably of from 0.1% to 2% by weight of the total composition of said acid.

Suitable acids for use herein may be organic acids, inorganic acids, or mixtures thereof. Preferred organic acids are citric, maleic, oxalic, succinic, tartaric acids or mixtures thereof. A preferred inorganic acid is sulphuric acid.

Substantially Linear Nonionic Surfactants

As a second essential ingredient, the compositions of the present invention comprise a substantially linear nonionic surfactant having the general formula: $R—(A)_x—(B)_y—(C)_z—O—R_1$ wherein: R is an even numbered $C_6$ to $C_{22}$ alkyl chain or a mixture thereof, containing at least 90%, preferably at least 95%, more preferably at least 97%, and most preferably 100% linear alkyl chains; A is an ethoxy unit; B is a butoxy unit; C is a propoxy unit; x, y and z are independent integers of from 0 to 20; the sum of x+y+z is at least 1, preferably from 1 to 15, more preferably from 2 to 15 and most preferably from 2 to 12; and $R_1$ is H, a $C_6$ to $C_{22}$ alkyl chain, preferably a $C_8$ to $C_{22}$ alkyl chain, or a $C_6$ to $C_{28}$ alkyl benzene chain.

Preferably R is an even numbered $C_8$ to $C_{22}$ alkyl chain or a mixture thereof, containing at least 90%, preferably at least 95%, more preferably at least 97%, and most preferably 100% linear alkyl chains. More preferably R is an even numbered $C_{12}$ to $C_{14}$ alkyl chain or a mixture thereof, containing at least 90%, preferably at least 95%, more preferably at least 97%, and most preferably 100% linear alkyl chains.

Preferably $R_1$ is H or a linear $C_6$ to $C_{22}$ alkyl chain, preferably a linear $C_8$ to $C_{22}$ alkyl chain, or a $C_6$ to $C_{28}$ alkyl benzene chain, wherein the alkyl chain is linear.

In a preferred embodiment according to the present invention y and z are both 0 and x is from 1 to 15, preferably from 2–15, more preferably from 2–12.

By "linear" it is meant herein that the fatty alcohols used as a basis of the nonionic surfactant (raw material) at least 90%, preferably at least 95%, more preferably at least 97%, and most preferably 100% by weight of the total amount of fatty alcohols of linear (i.e., straight chain) fatty alcohols.

By "even numbered" it is meant herein that the R group comprises only alkyl chains having an even number of carbon atoms forming said alkyl chain.

In a preferred embodiment wherein the bleaching compositions herein comprise a peroxygen bleach, $R_1$ in the formula disclosed above is Hydrogen.

In another preferred embodiment wherein the bleaching compositions herein comprise a hypohalite bleach, $R_1$ in the formula disclosed above is a $C_6$ to $C_{22}$ alkyl chain, preferably a $C_8$ to $C_{22}$ alkyl chain, or a $C_6$ to $C_{28}$ alkyl benzene chain. More preferably, $R_1$ is a linear $C_6$ to $C_{22}$ alkyl chain, preferably a linear $C_8$ to $C_{22}$ alkyl chain, or a $C_6$ to $C_{28}$ alkyl benzene chain, wherein the alkyl chain is linear.

Suitable substantially linear nonionic surfactants wherein $R_1$ is H for use herein are Marlipal® 24-7 (R is a mixture of linear $C_{12}$ and $C_{14}$ alkyl chains, x is 7, y and z are both 0), Marlipal® 24-4 (R is a mixture of linear $C_{12}$ and $C_{14}$ alkyl chains, x is 4, y and z are both 0), Marlipal® 24-3 (R is a mixture of linear $C_{12}$ and $C_{14}$ alkyl chains, x is 3, y and z are both 0), Marlipal® 24-2 (R is a mixture of linear $C_{12}$ and $C_{14}$ alkyl chains, x is 2, y and z are both 0), or mixtures thereof. Preferred herein are Marlipal® 24-7, Marlipal® 24-4, or mixtures thereof. These Marlipal® surfactants are commercially available from Condea.

Suitable chemical processes for preparing the alkoxylated substantially linear nonionic surfactants for use herein include condensation of corresponding substantially linear alcohols with alkylene oxide, in the desired proportions. Such processes are well-known to the person skilled in the art and have been extensively described in the art.

Typically, the compositions according to the present invention may comprise from 0.01% to 30%, preferably from 0.1% to 30% and more preferably from 0.5% to 20% by weight of the total composition of a substantially linear nonionic surfactant.

A significant stain removal performance benefit has been observed using a substantially linear nonionic surfactant in a bleaching composition when used in any laundry treating, i.e., cleaning and/or bleaching, operation.

The substantially linear nonionic surfactants as disclosed herein are preferably based on fatty alcohols (i.e., higher aliphatic alcohols) coming from natural feedstock (i.e., naturally occurring raw materials as natural fats and oils) or are synthetically produced using ethylene as feedstock by the Ziegler process for the production of fatty alcohols (see Kirk-Othmer, Encyclopedia of Chemical Technology, $4^{th}$ Edition, vol. 1, pages 894–903). Fatty alcohols coming from natural feedstock or produced by the Ziegler process have an even number of carbon atoms and at least 95% of the fatty alcohols molecules are linear (see Kirk-Othmer, Encyclopedia of Chemical Technology, $4^{th}$ Edition, vol. 1, pages 901 and 903).

The Applicant has found that the specific selected substantially linear nonionic surfactants having an even number of carbon atoms are particularly good surfactants, such that when formulated in the compositions herein, they provide superior cleaning.

The present compositions comprising a bleach, e.g., a peroxygen bleach or a hypohalite bleach, and a substantially linear nonionic surfactant as described herein when used in any laundry treating operation, show excellent stain removal performance on various types of stains, including greasy stains (e.g., lipstick, olive oil, mayonnaise, vegetal oil, sebum, make-up) and enzymatic stains. Particularly, the stain removal performance is improved, as compared to the stain removal performance delivered by the use of the same compositions but with a branched or a mixed branched/linear nonionic surfactant or no surfactant at all. By "branched or mixed branched/linear nonionic surfactants" it is meant herein that the fatty alcohols used to produce. e.g., alkoxylate, the nonionic surfactant (raw material) contain more than 10%, typically 25±10% by weight of the total amount of fatty alcohols of branched fatty alcohols. Said branched or mixed branched/linear nonionic surfactants are generally those conventionally used in liquid bleaching compositions.

Examples of mixed branched/linear nonionic surfactants are Dobanol®, Lutensol® or Tergitol® surfactants. Said surfactants are non-capped nonionic surfactant containing a mixture of linear and branched alkoxylated fatty alcohols. Dobanol® 23-3 for example is a nonionic surfactant based on a mixture of ethoxylated fatty acids having $C_{12}$ and $C_{13}$ alkyl chains. Dobanol® 45-7 is a nonionic surfactant based on a mixture of ethoxylated fatty acids having $C_{14}$ and $C_{15}$ alkyl chains. Dobanol® 91-8 is a nonionic surfactant based on a mixture of ethoxylated fatty acids having $C_9$ and $C_{11}$ alkyl chains. Dobanol® 91-10 is a nonionic surfactant based on a mixture of ethoxylated fatty acids having $C_9$ and $C_{11}$ alkyl chains.

The stain removal performance may be evaluated by the following test methods on various types of stains.

A suitable test method for evaluating the stain removal performance on a soiled fabric under pretreatment condition is the following: A composition according to the present invention is applied neat to a fabric preferably to the soiled portion of the fabric, left to act from 1 to 10 minutes, and said pretreated fabric is then washed according to common washing conditions, at a temperature of from 30° to 70° C. for from 10 to 100 minutes. The stain removal is then evaluated by comparing side by side the soiled fabric pretreated with the composition of the present invention with those pretreated with the reference, e.g., the same composition but no or another surfactant system. A visual grading may be used to assign difference in panel units (psu) in a range from 0 to 4.

Additionally, due to the presence of a bleach, the bleaching compositions as described herein also provide excellent bleaching performance.

The bleaching performance may be evaluated as for the stain removal performance but the stains used are bleachable stains like coffee, tea and the like.

Optional Co-surfactants

The compositions of the present invention may comprise a co-surfactant as an optional ingredient. Suitable co-surfactants include other nonionic surfactants than the ones mentioned herein before, zwitterionic surfactants, anionic surfactants, cationic surfactants and/or amphoteric surfactants.

In a preferred embodiment wherein the bleaching compositions herein comprise a peroxygen bleach as bleach, the compositions according to the present invention further comprise another nonionic surfactant in addition to the ones mentioned herein before or a zwitterionic betaine surfactant or a mixture thereof.

In another preferred embodiment wherein the bleaching compositions herein comprise a peroxygen bleach as bleach, the compositions according to the present invention further comprise a sulphonated anionic surfactant. The Applicant has identified a synergy in the combination of sulphonated anionic surfactants and other surfactants as for example nonionic surfactants, preferably alkoxylated nonionic surfactants, as described in the Applicant's co-pending European Patent Application No. 98870251.0.

Typically, the compositions according to the present invention may comprise from 0.01% to 30%, preferably from 0.1% to 25% and more preferably from 0.5% to 20% by weight of the total composition of a co-surfactant.

Suitable other nonionic surfactants include alkoxylated nonionic surfactants based on a mixture of fatty alcohols consisting of more than 10% by weight of the total amount of fatty alcohols of branched fatty alcohols. Preferred alkoxylated surfactants herein are ethoxylated nonionic surfactants according to the formula RO—$(C_2H_4O)_nH$, wherein R is a $C_6$ to $C_{22}$ alkyl chain or a $C_6$ to $C_{28}$ alkyl benzene chain, and wherein n is from 0 to 20, preferably from 1 to 15 and, more preferably from 2 to 15 and most preferably from 2 to 12. The preferred R chains for use herein are the $C_8$ to $C_{22}$ alkyl chains. Propoxylated nonionic surfactants and ethoxy/propoxylated ones may also be used herein instead of the ethoxylated nonionic surfactants as defined herein above or together with said surfactants.

Preferred ethoxylated nonionic surfactants are according to the formula above and have an HLB (hydrophilic-lipophilic balance) below 16, preferably below 15, and more preferably below 14. Those ethoxylated nonionic surfactants have been found to provide good grease cutting properties.

Accordingly suitable ethoxylated nonionic surfactants for use herein are Dobanol® 91-2.5 (HLB=8.1; R is a mixture of $C_9$ and $C_{11}$ alkyl chains, n is 2.5), or Lutensol® TO3 (HLB=8; R is a $C_{13}$ alkyl chains, n is 3), or Lutensol® AO3 (HLB=8; R is a mixture of $C_{13}$ and $C_{15}$ alkyl chains, n is 3), or Tergitol® 25L3 (HLB=7.7; R is in the range of $C_{12}$ to $C_{15}$ alkyl chain length, n is 3), or Dobanol® 23-3 (HLB=8.1; R is a mixture of $C_{12}$ and $C_{13}$ alkyl chains, n is 3), or Dobanol® 23-2 (HLB=6.2; R is a mixture Of $C_{12}$ and $C_{13}$ alkyl chains, n is 2), or Dobanol® 45-7 (HLB=11.6; R is a mixture of $C_{14}$ and $C_{15}$ alkyl chains, n is 7) Dobanol® 23-6.5 (HLB=11.9; R is a mixture of $C_{12}$ and $C_{13}$ alkyl chains, n is 6.5), or Dobanol® 25-7 (HLB=12; R is a mixture of $C_{12}$ and $C_{15}$ alkyl chains, n is 7), or Dobanol® 91-5 (HLB=11.6; R is a mixture of $C_9$ and $C_{11}$ alkyl chains, n is 5), or Dobanol® 91-6 (HLB=12.5; R is a mixture of $C_9$ and $C_{11}$ alkyl chains, n is 6), or Dobanol® 91-8 (HLB=13.7; R is a mixture of $C_9$ and $C_{1\ 1}$ alkyl chains, n is 8), Dobanol® 91-10 (HLB=14.2; R is a mixture of $C_9$ to $C_{11}$ alkyl chains, n is 10), Dobanol® 91-12 (HLB=14.5; R is a mixture of $C_9$ to C 1 alkyl chains, n is 12), or mixtures thereof. Preferred herein are Dobanol® 91-2.5, or Lutensol® TO3, or Lutensol® AO3, or Tergitol® 25L3, or Dobanol® 23-3, or Dobanol® 23-2 or Dobanol® 45-7, Dobanol® 91-8, or Dobanol® 91-10, or Dobanol® 91-12, or mixtures thereof. These Dobanol® surfactants are commercially available from SHELL. These Lutensol® surfactants are commercially available from BASF and these Tergitol® surfactants are commercially available from UNION CARBIDE.

Suitable chemical processes for preparing the alkoxylated nonionic surfactants for use herein include condensation of corresponding alcohols with alkylene oxide, in the desired proportions. Such processes are well known to the person skilled in the art and have been extensively described in the art.

Other suitable nonionic surfactants to be used herein include polyhydroxy fatty acid amide surfactants, or mixtures thereof, according to the formula.

$$R^2—C(O)—N(R^1)—Z,$$

wherein $R^1$ is H, or $C_1$–$C_4$ alkyl, $C_1$–$C_4$ hydrocarbyl, 2-hydroxy ethyl, 2-hydroxy propyl or a mixture thereof, $R^2$ is $C_5$–$C_{31}$ hydrocarbyl, and Z is a polyhydroxyhydrocarbyl having a linear hydrocarbyl chain with at least 3 hydroxyls directly connected to the chain, or an alkoxylated derivative thereof.

Preferably, $R^1$ is $C_1$–$C_4$ alkyl, more preferably $C_1$ or $C_2$ alkyl and most preferably methyl, $R^2$ is a straight chain $C_7$–$C_{19}$alkyl or alkenyl, preferably a straight chain $C_9$–$C_{18}$ alkyl or alkenyl, more preferably a straight chain $C_{11}$–$C_{18}$ alkyl or alkenyl, and most preferably a straight chain $C_{11}$–$C_{14}$ alkyl or alkenyl, or mixtures thereof. Z preferably will be derived from a reducing sugar in a reductive amination reaction; more preferably Z is a glycityl. Suitable reducing sugars include glucose, fructose, maltose, lactose, galactose, mannose and xylose. As raw materials, high dextrose corn syrup, high fructose corn syrup, and high maltose corn syrup can be utilized as well as the individual sugars listed above.

These corn syrups may yield a mix of sugar components for Z. It should be understood that it is by no means intended to exclude other suitable raw materials. Z preferably will be selected from the group consisting of —$CH_2$—$(CHOH)_n$—$CH_2OH$, —$CH(CH_2OH)$—$(CHOH)_{n-1}$—$CH_2OH$, —$CH_2$—$(CHOH)_2$—$(CHOR')(CHOH)$—$CH_2OH$, where n is an integer from 3 to 5, inclusive, and R' is H or a cyclic or aliphatic monosaccharide, and alkoxylated derivatives thereof. Most preferred are glycityls wherein n is 4, particularly $CH_2$—$(CHOH)_4$—$CH_2OH$.

In formula $R^2$—C(O)—N($R^1$)—Z, $R^1$ can be, for example, N-methyl, N-ethyl, N-propyl, N-isopropyl, N-butyl, N-2-hydroxy ethyl, or N-2-hydroxy propyl. $R^2$—C(O)—N< can be, for example, cocamide, stearamide, oleamide, lauramide, myristamide, capricamide, palmitamide, tallowamide and the like. Z can be 1-deoxyglucityl, 2-deoxyfructityl, 1-deoxymaltityl, 1-deoxylactityl, 1-deoxygalactityl, 1-deoxymannityl, 1-deoxymaltotriotityl and the like.

Suitable polyhydroxy fatty acid amide surfactants to be used herein may be commercially available under the trade name HOE® from Hoechst.

Methods for making polyhydroxy fatty acid amide surfactants are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed for example in GB patent specification 809,060, published Feb. 18, 1959, by Thomas Hedley & Co., Ltd., U.S. Pat. No. 2,965,576, issued Dec. 20, 1960 to E. R. Wilson, U.S. Pat. No. 2,703,798, Anthony M. Schwartz, issued Mar. 8, 1955, U.S. Pat. No. 1,985,424, issued Dec. 25, 1934 to Piggott and WO92/06070, each of which is incorporated herein by reference.

Suitable zwitterionic betaine surfactants for use herein contain both a cationic hydrophilic group, i.e., a quaternary ammonium group, and anionic hydrophilic group on the same molecule at a relatively wide range of pH's. The typical anionic hydrophilic groups are carboxylates and sulphonates, although other groups like sulfates, phosphonates, and the like can be used. A generic formula for the zwitterionic betaine surfactant to be used herein is:

$$R_1—N^+(R_2)(R_3)R_4X—$$

wherein $R_1$ is a hydrophobic group; $R_2$ is hydrogen, $C_1$–$C_6$ alkyl, hydroxy alkyl or other substituted $C_1$–$C_6$ alkyl group; $R_3$ is $C_1$–$C_6$ alkyl, hydroxy alkyl or other substituted $C_1$–$C_6$ alkyl group which can also be joined to $R_2$ to form ring structures with the N, or a $C_1$–$C_6$ sulphonate group; $R_4$ is a moiety joining the cationic nitrogen atom to the hydrophilic group and is typically an alkylene, hydroxy alkylene, or polyalkoxy group containing from 1 to 10 carbon atoms; and X is the hydrophilic group, which is a carboxylate or sulphonate group.

Preferred hydrophobic groups $R_1$ are aliphatic or aromatic, saturated or unsaturated, substituted or unsubstituted hydrocarbon chains that can contain linking groups such as amido groups, ester groups. More preferred $R_1$ is an alkyl group containing from 1 to 24 carbon atoms, preferably from 8 to 18, and more preferably from 10 to 16. These simple alkyl groups are preferred for cost and stability reasons. However, the hydrophobic group $R_1$ can also be an amido radical of the formula $R_a$—C(O)—NH—$(C(R_b)_2)_m$, wherein $R_a$ is an aliphatic or aromatic, saturated or unsaturated, substituted or unsubstituted hydrocarbon chain, preferably an alkyl group containing from 8 up to 20 carbon atoms, preferably up to 18, more preferably up to 16, $R_b$ is selected from the group consisting of hydrogen and hydroxy groups, and m is from 1 to 4, preferably from 2 to 3, more preferably 3, with no more than one hydroxy group in any $(C(R_b)_2)$ moiety.

Preferred $R_2$ is hydrogen, or a $C_1$–$C_3$ alkyl and more preferably methyl. Preferred $R_3$ is $C_1$–$C_4$ sulphonate group, or a $C_1$–$C_3$ alkyl and more preferably methyl. Preferred $R_4$ is $(CH_2)_n$wherein n is an integer from 1 to 10, preferably from 1 to 6, more preferably is from 1 to 3.

Some common examples of betaine/sulphobetaine are described in U.S. Pat. Nos. 2,082,275, 2,702,279 and 2,255,082, incorporated herein by reference.

Examples of particularly suitable alkyidimethyl betaines include coconut-dimethyl betaine, lauryl dimethyl betaine, decyl dimethyl betaine. 2-(N-decyl-N, N-dimethylammonia)acetate, 2-(N-coco N,N-dimethylammonio) acetate, myristyl dimethyl betaine, palmityl dimethyl betaine, cetyl dimethyl betaine, stearyl dimethyl betaine. For example Coconut dimethyl betaine is commercially available from Seppic under the trade name of Amonyl 265®. Lauryl betaine is commercially available from Albright & Wilson under the trade name Empigen BB/L®.

Examples of amidobetaines include cocoamidoethylbetaine, cocoamidopropyl betaine or $C_{10}$–$C_{14}$ fatty acylamidopropylene(hydropropylene) sulfobetaine. For example $C_{10}$–$C_{14}$ fatty acylamidopropylene(hydropropylene)sulfobetaine is commercially available from Sherex Company under the trade name "Varion CAS® sulfobetaine".

A further example of betaine is Lauryl-imminodipropionate commercially available from Rhone-Poulenc under the trade name Mirataine $H_2C$—HA®.

Suitable anionic surfactants to be used in the compositions herein include water-soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like). Typically, alkyl chains of $C_{12-16}$ are preferred for lower wash temperatures (e.g., below 50° C.) and $C_{16-18}$ alkyl chains are preferred for higher wash temperatures (e.g., above 50° C.).

Other suitable anionic surfactants for use herein are water-soluble salts or acids of the formula $RO(A)_mSO_3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between 0.5 and 6, more preferably between 0.5 and 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium and quaternary ammonium cations, such as tetramethyl-ammonium, dimethyl piperdinium and cations derived from alkanolamines such as ethylamine, diethylamine, triethylamine, mixtures thereof, and the like. Exemplary surfactants are $C_{12}$–$C_{18}$ alkyl polyethoxylate (1.0) sulfate ($C_{12}$–$C_{18}$E(1.0)SM), $C_{12}$–$C_{18}$ alkyl polyethoxylate (2.25) sulfate ($C_{12}$–$C_{18}$E(2.25)SM), $C_{12}$–$C_{18}$ alkyl polyethoxylate (3.0) sulfate ($C_{12}$–$C_{18}$E(3.0)SM), and $C_{12}$–$C_{18}$ alkyl polyethoxylate (4.0) sulfate ($C_{12}$–$C_{18}$E(4.0)SM), wherein M is conveniently selected from sodium and potassium.

Other suitable anionic surfactants for use herein are sulphonated anionic surfactants Suitable sulphonated anionic surfactants for use herein include alkyl sulphonates, alkyl aryl sulphonates, naphthalene sulphonates, alkyl alkoxylated sulphonates, $C_6$–$C_{20}$ alkyl alkoxylated linear or branched diphenyl oxide disulphonates, or mixtures thereof.

Suitable alkyl sulphonates for use herein include water-soluble salts or acids of the formula $RSO_3M$ wherein R is a $C_6$–$C_{20}$ linear or branched, saturated or unsaturated alkyl group, preferably a $C_8$–$C_{18}$ alkyl group and more preferably a $C_{14}$–$C_{17}$ alkyl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Suitable alkyl aryl sulphonates for use herein include water-soluble salts or acids of the formula $RSO_3M$ wherein R is an aryl, preferably a benzyl, substituted by a $C_6$–$C_{20}$ linear or branched saturated or unsaturated alkyl group, preferably a $C_8$–$C_{18}$ alkyl group and more preferably a $C_{10}$–$C_{16}$ alkyl group, and M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Particularly suitable linear alkyl sulphonates include $C_{14}$–$C_{17}$ paraffin sulphonate like Hostapur® SAS commercially available from Hoechst. An example of commercially available alkyl aryl sulphonate is Lauryl aryl sulphonate from Su.Ma. Particularly preferred alkyl aryl sulphonates are alkyl benzene sulphonates commercially available under trade name Nansa® available from Albright&Wilson.

By "linear alkyl sulphonate" it is meant herein a non-substituted alkyl sulphonate wherein the alkyl chain comprises from 6 to 20 carbon atoms, preferably from 8 to 18 carbon atoms, and more preferably from 14 to 17 carbon atoms, and wherein this alkyl chain is sulphonated at one terminus.

Suitable alkoxylated sulphonate surfactants for use herein are according to the formula $R(A)_mSO_3M$ wherein R is an unsubstituted $C_6$–$C_{20}$ alkyl, hydroxyalkyl or alkyl aryl group, having a linear or branched $C_6$–$C_{20}$ alkyl component, preferably a $C_{12}$–$C_{20}$ alkyl or hydroxyalkyl, more preferably $C_{12}$–$C_{18}$ alkyl or hydroxyalkyl, A is an ethoxy, or propoxy or butoxy unit, m is greater than zero, typically between 0.5 and 6, more preferably between 0.5 and 3, and M is H or a cation which can be, for example, a metal cation (e.g., sodium, potassium, lithium, calcium, magnesium, etc.), ammonium or substituted-ammonium cation. Alkyl ethoxylated sulphonates, alkyl butoxylated sulphonates as well as alkyl propoxylated sulphonates are contemplated herein. Specific examples of substituted ammonium cations include methyl-, dimethyl-, trimethyl-ammonium and quaternary ammonium cations, such as tetramethyl-ammonium, dimethyl piperdinium and cations derived, from alkanolamines such as ethylamine, diethylamine, triethylamine, mixtures thereof, and the like. Exemplary surfactants are $C_{12}$–$C_{18}$ alkyl polyethoxylate (1.0) sulphonate ($C_{12}$–$C_{18}E(1.0)$ $SO_3M$), $C_{12}$–$C_{18}$ alkyl polyethoxylate (2.25) sulphonate ($C_{12}$–$C_{18}E(2.25)$ $SO_3M$), $C_{12}$–$C_{18}$ alkyl polyethoxylate (3.0) sulphonate ($C_{12}$–$C_{18}E(3.0)$ $SO_3M$), and $C_{12}$–$C_{18}$ alkyl polyethoxylate (4.0) sulphonate ($C_{12}$–$C_{18}E(4.0)$ $SO_3M$), wherein M is conveniently selected from sodium and potassium. Particularly suitable alkoxylated sulphonates include alkyl aryl polyether sulphonate like Triton X-200® commercially available from Union Carbide.

Suitable $C_6$–$C_{20}$ alkyl alkoxylated linear or branched diphenyl oxide disulphonate surfactants for use herein are according to the following formula:

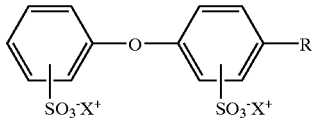

Wherein R is a $C_6$–$C_{20}$ linear or branched, saturated or unsaturated alkyl group, preferably a $C_{12}$–$C_{18}$ alkyl group and more preferably a $C_{14}$–$C_{16}$ alkyl group, and X+ is H or a cation, e.g., an alkali metal cation (e.g., sodium, potassium, lithium, calcium, magnesium and the like). Particularly suitable $C_6$–$C_{20}$ alkyl alkoxylated linear or branched diphenyl oxide disulphonate surfactants to be used herein are the $C_{12}$ branched di phenyl oxide disulphonic acid and $C_{16}$ linear di phenyl oxide disulphonate sodium salt respectively commercially available by DOW under the trade name Dowfax 2A1® and Dowfax 8390®.

Other anionic surfactants useful for detersive purposes can also be used herein. These can include salts (including, for example, sodium, potassium, ammonium, and substituted ammonium salts such as mono-, di- and triethanolamine salts) of soap, sulphonated polycarboxylic acids prepared by sulphonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl ester sulphonates such as $C_{14}$–$C_{16}$ methyl ester sulphonates; acyl glycerol sulphonates, fatty oleyl glycerol sulfates, alkyl phenol ethylene oxide ether sulfates, alkyl phosphates, isethionates such as the acyl isethionates, N-acyl taurates, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_k$ $CH_2COO—M^+$ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975, to Laughlin, et al. at Column 23, line 58 through Column 29, line 23 (herein incorporated by reference).

Other suitable anionic surfactants to be used herein also include acyl sarcosinate or mixtures thereof, in its acid and/or salt form, preferably long chain acyl sarcosinates having the following formula:

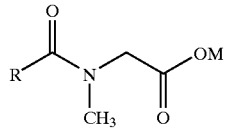

Wherein M is hydrogen or a cationic moiety and wherein R is an alkyl group of from 11 to 15 carbon atoms, preferably of from 11 to 13 carbon atoms. Preferred M are hydrogen and alkali metal salts, especially sodium and potassium. Said acyl sarcosinate surfactants are derived from natural fatty acids and the amino-acid sarcosine (N-methyl glycine). They are suitable to be used as aqueous solution of their salt or in their acidic form as powder. Being derivatives of natural fatty acids, said acyl sarcosinates are rapidly and completely biodegradable and have good skin compatibility.

Accordingly, suitable long chain acyl sarcosinates to be used herein include $C_{12}$ acyl sarcosinate (i.e., an acyl sarcosinate according to the above formula wherein M is hydrogen and R is an alkyl group of 11 carbon atoms) and $C_{14}$ acyl sarcosinate (i.e., an acyl sarcosinate according to the above formula wherein M is hydrogen and R is an alkyl group of 13 carbon atoms). $C_{12}$ acyl sarcosinate is commercially available, for example, as Hamposyl L-30® supplied by Hampshire. $C_{14}$ acyl sarcosinate is commercially available, for example, as Hamposyl M-30® supplied by Hampshire.

Suitable amphoteric surfactants to be used herein include amine oxides having the following formula $R_1R_2R_3NO$ wherein each of $R_1$, $R_2$ and $R_3$ is independently a saturated substituted or unsubstituted, linear or branched hydrocarbon chains of from 1 to 30 carbon atoms. Preferred amine oxide surfactants to be used according to the present invention are amine oxides having the following formula $R_1R_2R_3NO$ wherein $R_1$ is an hydrocarbon chain comprising from 1 to 30 carbon atoms, preferably from 6 to 20, more preferably from 8 to 16, most preferably from 8 to 12, and wherein $R_2$ and $R_3$ are independently substituted or unsubstituted, linear or branched hydrocarbon chains comprising from 1 to 4 carbon atoms, preferably from 1 to 3 carbon atoms, and more preferably are methyl groups. R1 may be a saturated substituted or unsubstituted linear or branched hydrocarbon chain. Suitable amine oxides for use herein are for instance natural blend $C_8$–$C_{10}$ amine oxides as well as $C_{12}$–$C_{16}$ amine oxides commercially available from Hoechst.

Optional Ingredients

The compositions herein may further comprise a variety of other optional ingredients such as chelating agents, builders, hydrotropes, stabilisers, bleach activators, solvents, soil suspenders, soil suspending polyamine polymers, soil release agents, pH buffering components, foam reducing systems, radical scavengers, antioxidant, catalysts, dye transfer inhibitors, rheology modifiers, brighteners, perfumes, pigments and dyes.

Chelating Agents

The compositions of the present invention may comprise a chelating agent as a preferred optional ingredient. Suitable chelating agents may be any of those known to those skilled in the art such as the ones selected from the group comprising phosphonate chelating agents, amino carboxylate chelating agents, other carboxylate chelating agents, polyfunctionally-substituted aromatic chelating agents, ethylenediamine N,N'-disuccinic acids, or mixtures thereof.

A chelating agent may be desired in the compositions of the present invention as it allows to increase the ionic strength of the compositions herein and thus their stain removal and bleaching performance on various surfaces. The presence of chelating agents may also contribute to reduce the tensile strength loss of fabrics and/or color damage, especially in a laundry through-the-wash application. Indeed, the chelating agents inactivate the metal ions present on the surface of the fabrics and/or in the cleaning compositions (neat or diluted) that otherwise would contribute to the radical decomposition of the bleach, preferably the peroxygen bleach.

Suitable phosphonate chelating agents to be used herein may include alkali metal ethane 1-hydroxy diphosphonates (HEDP), alkylene poly (alkylene phosphonate), as well as amino phosphonate compounds, including amino aminotri (methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agents to be used herein are diethylene triamine penta methylene phosphonate (DTPMP) and ethane 1-hydroxy diphosphonate (HEDP). Such phosphonate chelating agents are commercially available from Monsanto under the trade name DEQUEST®.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer, have been extensively described in U.S. Pat. No. 4,704,233, Nov. 3, 1987, to Hartman and Perkins. Ethylenediamine N,N'-disuccinic acid is, for instance, commercially available under the tradename ssEDDS® from Palmer Research Laboratories.

Suitable amino carboxylates to be used herein include ethylene diamine tetra acetates, diethylene triamine pentaacetates, diethylene triamine pentaacetate (DTPA), N-hydroxyethylethylenediamine triacetates, nitrilotriacetates, ethylenediamine tetrapropionates, triethylenetetraaminehexa-acetates, ethanol-diglycines, propylene diamine tetracetic acid (PDTA) and methyl glycine di-acetic acid (MGDA), both in their acid form, or in their alkali metal, ammonium, and substituted ammonium salt forms. Particularly suitable amino carboxylates to be used herein are diethylene triamine penta acetic acid, propylene diamine tetracetic acid (PDTA) which is, for instance, commercially available from BASF under the trade name Trilon FS® and methyl glycine di-acetic acid (MGDA).

Further carboxylate chelating agents to be used herein include salicylic acid, aspartic acid, glutamic acid, glycine, malonic acid or mixtures thereof.

Another chelating agent for use herein is of the formula:

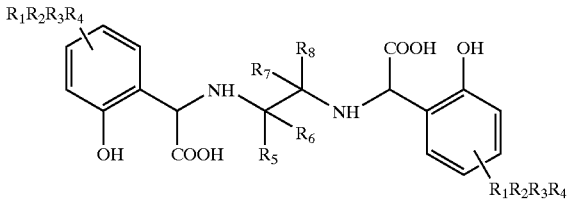

wherein $R_1$, $R_2$, $R_3$, and $R_4$ are independently selected from the group consisting of —H, alkyl, alkoxy, aryl, aryloxy, —Cl, —Br, —$NO_2$, —C(O)R', and —$SO_2$R'; wherein R' is selected from the group consisting of —H, —OH, alkyl, alkoxy, aryl, and aryloxy; R" is selected from the group consisting of alkyl, alkoxy, aryl, and aryloxy; and $R_5$, $R_6$, $R_7$, and $R_8$ are independently selected from the group consisting of —H and alkyl.

Particularly preferred chelating agents to be used herein are amino aminotri(methylene phosphonic acid), di-ethylene-triamino-pentaacetic acid, diethylene triamine penta methylene phosphonate, 1-hydroxy ethane diphosphonate, ethylenediamine N,N'-disuccinic acid, and mixtures thereof.

Typically, the compositions according to the present invention may comprise up to 5%, preferably from 0.01% to 1.5% by weight and more preferably from 0.01% to 0.5% by weight of the total composition of a chelating agent.

Builders

The compositions according to the present invention may further comprise a builder or a mixture thereof.

Suitable builders are selected from the group consisting of: organic acids and salts thereof; polycarboxylates; and mixtures thereof. Typically said builders have a calcium chelating constant (pKCa) of at least 3. Herein the pKCa the value of a builder or a mixture thereof is measured using an 0.1M $NH_4Cl$—$NH_4OH$ buffer (pH 10 at 25° C.) and a 0.1% solution of said builder or mixture thereof wit, a standard calcium ion electrode.

Examples of builders are organic acids like citric acid, lactic acid, tartari acid, oxalic acid, malic acid, monosuccinic acid, disuccinic acid, oxydisuccinic acid, carboxymethyl oxysuccinic acid, diglycolic acid, carboxymethyl tartronate, ditartronate and other organic acid or mixtures thereof.

Suitable salts of organic acids include alkaline, preferably sodium or potassium, alkaline earth metal, ammonium or alkanolamine salts.

Such organic acids and the salts thereof are commercially available from Jungbunziaur, Haarman & Reimen, Sigma-Aldrich or Fluka.

Other suitable builders include a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt or "overbased". When utilized in salt form, alkali metals, such as sodium, potassium, and lithium, or alkanolammonium salts are preferred.

Useful polycarboxylates include homopolymers of acrylic acid and copolymers of acrylic acid and maleic acid.

Other useful polycarboxylate builders include the ether hydroxypolycarboxylates, copolymers of maleic anhydride with ethylene or vinyl methyl ether, 1,3,5-trihydroxy benzene-2,4,6-trisulfonic acid, and carboxymethyloxysuccinic acid, the various alkali metal, ammonium and substituted ammonium salts of polyacetic acids such as nitrilotriacetic acid, as well as polycarboxylates such as mellitic acid. succinic acid, oxydisuccinic acid, polymaleic acid, benzene 1,3,5-tricarboxylic acid, carboxymethyloxysuccinic acid, and soluble salts thereof.

Suitable polycarboxylates are commercially available from Rohm & Haas under the trade name Norasol® or Acusol®.

Preferred builders herein are selected from the group consisting of: citric acid; tartaric acid; tartrate monosuccinate; tartrate disuccinate; lactic acid; oxalic acid; and malic acid; and mixtures thereof. Even more preferred builders herein are selected from the group consisting of: citric acid; tartaric acid; tartrate monosuccinate; tartrate disuccinate; and malic acid; and mixtures thereof. The most preferred builders herein are selected from the group consisting of citric acid; tartaric acid; tartrate monosuccinate; and tartrate disuccinate; and mixtures thereof.

Other suitable builders include modified polycarboxylate co-builders.

Preferred modified polycarboxylate co-builders are polycarboxylates with phosphono end groups.

By "polycarboxylates with phosphono end group" it is meant that a phosphono group is attached to at least one end of a polycarboxylate chain.

Examples of suitable polycarboxylates with phosphono end groups are copolymers of acrylic acid and maleic acid having a phosphono end group and homopolymers of acrylic acid having a phosphono end group.

Such modified polycarboxylate are available from Rohm & Haas under the trade name Acusol 425®, Acusol 420® or Acusol 470®.

Typically the compositions herein may comprise up to 40%, preferably from 0.01% to 25%, more preferably from 0.1% to 15%, and most preferably from 0.5% to 10% by weight of the total composition of said builder.

Solvents

The compositions according to the present invention may further comprise a solvent or a mixture thereof.

Preferred solvents herein include hydrophobic solvents, hydrophilic solvents and mixtures hereof.

To define the hydrophilic or hydrophobic character of a solvent herein, the following hydrophilic index (HI) is used:

$$\frac{\text{molecular weight of the hydrophilic part of the solvent}}{\text{total molecular weight of the solvent}} + 100$$

By "hydrophilic part" of a given solvent it is meant herein all the groups O, CO, OH, of a given solvent.

By "molecular weight of the hydrophilic part of a solvent" it is meant herein the total molecular weight of all the hydrophilic parts of a given solvent.

The hydrophilic solvents to be used herein have a hydrophilic index of more than 18, preferably more than 25, and more preferably more than 30, and the hydrophobic solvents to the used herein have a hydrophilic index of less than 18, preferably less than 17 and more preferably 16 or less.

Suitable hydrophobic solvents to be used herein include paraffins, terpenes or terpene derivatives, as well as alkoxylated aliphatic or aromatic alcohols, aliphatic or aromatic alcohols, glycols or alkoxylated glycols, and mixtures thereof, all these solvents have a hydrophilic index of less than 18.

Suitable terpenes (hydrophilic index of 0) are mono-and bicyclic monoterpenes, especially those of the hydrocarbon class, which include the terpinenes, terpinolenes, limonenes and pinenes and mixtures thereof. Highly preferred materials of this type are d-limonene, dipentene, alpha-pinene and/or beta-pinene. For example, pinene is commercially available form SCM Glidco (Jacksonville) under the name Alpha Pinene P&F®.

Terpene derivatives such as alcohols, aldehydes, esters, and ketones which have a hydrophilic index of less than 18 can also be used herein. Such materials are commercially available as, for example, the α and β isomers of terpineol and linalool.

All type of paraffins (hydrophilic index of 0) can be used herein, both linear and branched, containing from 2 to 20, preferably from 4 to 10, more preferably from 6 to 8 carbon atoms. Preferred herein is octane. Octane is commercially available for example from BASF.

Suitable hydrophobic alkoxylated aliphatic or aromatic alcohols to be used herein are according to the formula $R—(A)_n—OH$ wherein R is a linear or branched saturated or unsaturated alkyl group, or alkyl substituted or non-alkyl substituted aryl group of from 1 to 20, preferably from 2 to 15 and more preferably from 2 to 10 carbon atoms, wherein A is an alkoxy group preferably an butoxy, propoxy and/or ethoxy group, and n is an integer of from 1 to 5, preferably 1 to 2. Suitable hydrophobic alkoxylated alcohol to be used herein is 1-methoxy-11-dodecanol (HI=15).

Suitable hydrophobic aliphatic or aromatic alcohols to be used herein are according to the formula R—OH wherein R is a linear or branched saturated or unsaturated alkyl group, or alkyl substituted or non-alkyl substituted aryl group of from 1 to 20, preferably from 2 to 15 and more preferably from 2 to 10 carbon atoms. Suitable aliphatic alcohols to be used herein include linear alcohols like decanol (HI=7). Suitable aromatic alcohol to be used herein is benzyl alcohol (HI=16).

Suitable hydrophobic glycols to be used herein are according to the formula $HO—CR_1R_2—OH$ wherein $R_1$ and $R_2$ are independently H or a $C_2$–$C_{10}$ saturated or unsaturated aliphatic hydrocarbon chain and/or cyclic hydrocarbon chain. Suitable glycol to be used herein is dodecaneglycol (HI=16).

Suitable hydrophobic alkoxylated glycols to be used herein are according to the formula $R—(A)_n—R_1—OH$ wherein R is H, OH, a linear saturated or unsaturated alkyl of from 1 to 20, preferably from 2 to 15 and more preferably from 2 to 10 carbon atoms, wherein $R_1$ is H or a linear saturated or unsaturated alkyl of from 1 to 20, preferably from 2 to 15 and more preferably from 2 to 10 carbon atoms, and A is an alkoxy group preferably an ethoxy, methoxy, and/or propoxy group and n is from 1 to 5, preferably 1 to 2. Suitable alkoxylated glycol to be used herein is methoxy octadecanol (HI=11).

Particularly preferred hydrophobic solvents to be used herein include d-limonene, dipentene, alpha-pinene, beta-pinene, octane, benzyl alcohol, or mixtures thereof.

Suitable hydrophilic solvents to be used herein include alkoxylated aliphatic or aromatic alcohols, aliphatic or aromatic alcohols, glycols or alkoxylated glycols, and mixtures thereof, all these solvents having a hydrophilic index of more than 18.

Suitable hydrophilic alkoxylated aliphatic or aromatic alcohols to be used herein are according to the formula $R—(A)_n—OH$ wherein R is a linear or branched saturated or unsaturated alkyl group, or alkyl substituted or non-alkyl substituted aryl group of from 1 to 20, preferably from 2 to 15 and more preferably from 2 to 10 carbon atoms, wherein A is an alkoxy group preferably a butoxy, propoxy and/or ethoxy group, and n is an integer of from 1 to 5, preferably 1 to 2. Particularly suitable alkoxylated alcohols to be used herein include methoxy propanol (HI=37), ethoxy propanol (HI=32), propoxy propanol (HI=28) and/or butoxy propanol (HI=27).

Suitable hydrophilic aliphatic or aromatic alcohols to be used herein are according to the formula R—OH wherein R is a linear or branched saturated or unsaturated alkyl group, or alkyl substituted or non-alkyl substituted aryl group of from 1 to 20, preferably from 2 to 15 and more preferably from 2 to 10 carbon atoms. Particularly suitable aliphatic alcohols to be used herein include linear alcohols like ethanol (HI=37) and/or propanol (HI=28).

Suitable hydrophilic glycols to be used herein are according to the formula $HO—CR_1R_2—OH$ wherein $R_1$ and $R_2$ are independently H or a $C_2$–$C_{10}$ saturated or unsaturated aliphatic hydrocarbon chain and/or cyclic hydrocarbon chain. Particularly suitable glycol to be used herein is propanediol (HI=45).

Suitable hydrophilic alkoxylated glycols to be used herein are according to the formula $R—(A)_n—R_1—OH$ wherein R is H, OH, a linear saturated or unsaturated alkyl group of from 1 to 20, preferably from 2 to 15 and more preferably from 2 to 10 carbon atoms, wherein $R_1$ is H or a linear saturated or unsaturated alkyl group of from 1 to 20, preferably from 2 to 15 and more preferably from 2 to 10 carbon atoms, and A is an alkoxy group preferably an ethoxy, methoxy, and/or propoxy group and n is from 1 to 5, preferably 1 to 2. Particularly suitable alkoxylated glycols to be used herein is ethoxyethoxyethanol (HI=37).

Typically, the compositions according to the present invention may comprise up to 30%, preferably from 0.01% to 15%, more preferably from 0.1% to 10%, and most preferably from 0.5% to 5% by weight of the total composition of a solvent.

In a preferred embodiment wherein the compositions herein comprise a mixture of a hydrophobic solvent and a hydrophilic solvent the weight ratio of said hydrophobic solvent to said hydrophilic is from 1:20 to 1:1, more preferably from 1:14 to 1:2.

Solvents, when present, contribute to the excellent stain removal performance of the compositions used in a process as described herein.

Foam Reducing System

The compositions according to the present invention may further comprise a foam reducing agent or a mixture thereof. Any foam reducing agents known to those skilled in the art are suitable for use herein. In a preferred embodiment a foam reducing system comprising a fatty acid together with a capped alkoxylated nonionic surfactant as defined herein after and/or silicone is used.

Typically, the compositions herein may comprise from $1\cdot10^{-4}$% to 10%, preferably from $1\cdot10^{-3}$% to 5% and more preferably from $1\cdot10^{-2}$% to 5% by weight of the total composition of a fatty acid.

Typically, the compositions herein may comprise from $1\cdot10^{-3}$% to 20%, preferably from $1\cdot10^{-2}$% to 10% and more preferably from $5\cdot10^{-2}$% to 5% by weight of the total composition of a capped alkoxylated nonionic surfactant as defined herein.

Typically, the compositions herein may comprise from $11\cdot^{-5}$% to 5%, preferably from $1\cdot10^{-5}$% to 1% and more preferably from $1\cdot10^{-4}$% to 0.5% by weight of the total composition of a silicone.

Suitable fatty acids for use herein are the alkali salts of a $C_8$–$C_{24}$ fatty acid. Such alkali salts include the metal fully saturated salts like sodium, potassium and/or lithium salts as well as the ammonium and/or alkylammonium salts of fatty acids, preferably the sodium salt. Preferred fatty acids for use herein contain from 8 to 22, preferably from 8 to 20 and more preferably from 8 to 18 carbon atoms.

Suitable fatty acids may be selected from caprylic acid, capric acid, lauric acid, myristic acid, paimitic acid, stearic acid, and mixtures of fatty acids suitably hardened, derived from natural sources such as plant or animal esters (e.g., palm oil, coconut oil, soybean oil, castor oil, tallow, ground oil, whale and fish oils and/or babassu oil.

For example Coconut Fatty Acid is commercially available from UNICHEMA under the name PRIFAC 5900®.

Suitable capped alkoxylated nonionic surfactants for use herein are according to the formula:

$$R_1(O—CH_2—CH_2)_n—(OR_2)_m—O—R_3$$

wherein $R_1$ is a $C_8$–$C_{24}$ linear or branched alkyl or alkenyl group, aryl group, alkaryl group, preferably $R_1$ is a $C_8$–$C_{18}$ alkyl or alkenyl group, more preferably a $C_{10}$–$C_{15}$ alkyl or alkenyl group, even more preferably a $C_{10}$–$C_{15}$ alkyl group; wherein $R_2$ is a $C_1$–$C_{10}$ linear or branched alkyl group, preferably a $C_2$–$C_{10}$ linear or branched alkyl group, preferably a $C_3$ group;

wherein $R_3$ is a $C_1$–$C_{10}$ alkyl or alkenyl group, preferably a $C_1$–$C_5$ alkyl group, more preferably methyl;

and wherein n and m are integers independently ranging in the range of from 1 to 20, preferably from 1 to 10, more preferably from 1 to 5; or mixtures thereof.

These surfactants are commercially available from BASF under the trade name Plurafac®, from HOECHST under the trade name Genapol® or from ICI under the trade name Symperonic®. Preferred capped nonionic alkoxylated surfactants of the above formula are those commercially available under the tradename Genapol® L 2.5 NR from Hoechst, and Plurafac® from BASF.

Suitable silicones for use herein include any silicone and silica-silicone mixtures. Silicones can be generally represented by alkylated polysiloxane materials while silica is normally used in finely divided forms exemplified by silica aerogels and xerogels and hydrophobic silicas of various types. These materials can be incorporated as particulates in which the silicone is advantageously releasably incorporated in a water-soluble or water-dispersible, substantially non-surface-active detergent impermeable carrier. Alternatively, the silicone can be dissolved or dispersed in a liquid carrier and applied by spraying on to one or more of the other components.

Actually in industrial practice, the term "silicone" has become a generic term which encompasses a variety of relatively high-molecular-weight polymers containing siloxane units and hydrocarbyl groups of various types. Indeed, silicone compounds have been extensively described in the art, see for instance U.S. Pat. No. 4,076,648, U.S. Pat. No. 4,021,365, U.S. Pat. No. 4,749,740, U.S. Pat. No. 4,983,316, EP 150 872, EP 217 501 and EP 499 364. The silicone compounds disclosed therein are suitable in the context of the present invention. Generally, the silicone compounds can be described as siloxanes having the general structure:

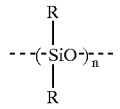

wherein n is from 20 to 2000, and where each R independently can be an alkyl or an aryl radical. Examples of such substituents are methyl, ethyl, propyl, isobutyl, and phenyl. Preferred polydiorganosiloxanes are polydimethylsiloxanes having trimethylsilyl end blocking units and having a viscosity at 25° C. of from $5\times10^{-5}$ $m^2/s$ to 0.1 $m^2/s$, i.e., a value of n in the range 40 to 1500. These are preferred because of their ready availability and their relatively low cost.

A preferred type of silicone compounds useful in the compositions herein comprises a mixture of an alkylated siloxane of the type herein above disclosed and solid silica.

The solid silica can be a fumed silica, a precipitated silica or a silica made by the gel formation technique. The silica particles can be rendered hydrophobic by treating them with diakylsilyl groups and/or trialkylsilane groups either bonded directly onto the silica or by means of silicone resin. A preferred silicone compound comprises a hydrophobic silanated, most preferably trimethylsilanated silica having a particle size in the range from 10 mm to 20 mm and a specific surface area above 50 $m^2/g$. Silicone compounds employed in the compositions according to the present invention suitably have an amount of silica in the range of 1 to 30% (more preferably 2.0 to 15%) by weight of the total weight of the silicone compounds resulting in silicone compounds having an average viscosity in the range of from $2\times10^{-4}$ $m^2/s$ to 1 $m^2/s$. Preferred silicone compounds may have a viscosity in the range of from $5\times10^{-3}m^2/s$ to 0.1 $m^2/s$. Particularly suitable are silicone compounds with a viscosity of $2\times10^{-2}m^2/s$ or $4.5\times10^{-2}m^2/s$.

Suitable silicone compounds for use herein are commercially available from various companies including Rhone Poulenc, Fueller and Dow Corning. Examples of silicone compounds for use herein are Silicone DB® 100 and Silicone Emulsion 2–3597® both commercially available from Dow Corning.

Another silicone compound is disclosed in Bartollota et al. U.S. Pat. No. 3,933,672. Other particularly useful silicone compounds are the self-emulsifying silicone compounds, described in German Patent Application DTOS 2 646 126 published Apr. 28, 1977. An example of such a compound is DC-544® commercially available from Dow Corning, which is a siloxane-glycol copolymer.

Typically preferred silicone compounds are described in European Patent application EP-A-573699. Said compositions can comprise a silicone/silica mixture in combination with fumed nonporous silica such as Aerosil®.

Radical Scavenger

The compositions of the present invention may comprise a radical scavenger or a mixture thereof. Suitable radical scavengers for use herein include the well-known substituted mono and dihydroxy benzenes and their analogs, alkyl and aryl carboxylates and mixtures thereof. Preferred such radical scavengers for use herein include di-tert-butyl hydroxy toluene (BHT), hydroquinone, di-tert-butyl hydroquinone, mono-tert-butyl hydroquinone, tert-butyl-hydroxy anysole, benzoic acid, toluic acid, catechol, t-butyl catechol, benzylamine, 1,1,3-tris(2-methyl-4-hydroxy-5-t-butylphenyl) butane, n-propyl-gallate or mixtures thereof and highly preferred is di-tert-butyl hydroxy toluene. Such radical scavengers like N-propyi-gallate may be commercially available from Nipa Laboratories under the trade name Nipanox S1®.

Radical scavengers when used, are typically present herein in amounts ranging from up to 10% and preferably from 0.001% to 0.5% by weight of the total composition.

The presence of radical scavengers may contribute to reduce tensile strength loss of fabrics and/or color damage when the compositions of the present invention are used in any laundry application.

Antioxidant

The compositions according to the present invention may further comprise an antioxidant or mixtures thereof.

Typically, the compositions herein may comprise up to 10%, preferably from 0.002% to 5%, more preferably from 0.005% to 2%, and most preferably from 0.01% to 1% by weight of the total composition of an antioxidant.

Suitable antioxidants to be used herein include organic acids like citric acid, ascorbic acid, tartaric acid, adipic acid and sorbic acid, or amines like lecithin, or aminoacids like glutamine, methionine and cysteine, or esters like ascorbil palmitate, ascorbil stearate and triethylcitrate, or mixtures thereof. Preferred antioxidants for use herein are citric acid, ascorbic acid, ascorbil palmitate, lecithin or mixtures thereof.

Bleach Activator

In an embodiment of the present invention where the bleaching compositions herein comprise a peroxygen bleach, said compositions may comprise a bleach activator or mixtures thereof. By "bleach activator", it is meant herein a compound which reacts with hydrogen peroxide to form a peracid. The peracid thus formed constitutes the activated bleach. Suitable bleach activators to be used herein include those belonging to the class of esters, amides, imides, or anhydrides. Examples of suitable compounds of this type are disclosed in British Patent GB 1 586 769 and GB 2 143 231 and a method for their formation into a prilled form is described in European Published Patent Application EP-A-62 523. Suitable examples of such compounds to be used herein are tetracetyl ethylene diamine (TAED), sodium 3,5,5 trimethyl hexanoyloxybenzene sulphonate, diperoxy dodecanoic acid as described for instance in U.S. Pat. No. 4,818,425 and nonylamide of peroxyadipic acid as described for instance in U.S. Pat. No. 4,259,201 and n-nonanoyloxybenzenesulphonate (NOBS). Also suitable are N-acyl caprolactams selected from the group consisting of substituted or unsubstituted benzoyl caprolactam, octanoyl caprolactam, nonanoyl caprolactam, hexanoyl caprolactam, decanoyl caprolactam, undecenoyl caprolactam, formyl caprolactam, acetyl caprolactam, propanoyl caprolactam, butanoyl caprolactam pentanoyl caprolactam or mixtures thereof. A particular family of bleach activators of interest was disclosed in EP 624 154, and particularly preferred in that family is acetyl triethyl citrate (ATC). Acetyl triethyl citrate has the advantage that it is environmental-friendly as it eventually degrades into citric acid and alcohol. Furthermore, acetyl triethyl citrate has a good hydrolytical stability in the product upon storage and it is an efficient bleach activator. Finally, it provides good building capacity to the composition.

The compositions according to the present invention may comprise from 0.01% to 20%, preferably from 1% to 10%, and more preferably from 3% to 7% by weight of the total composition of said bleach activator.

pH Buffering Components

In an embodiment of the present invention where the bleaching compositions herein comprise a hypohalite bleach, said compositions may comprise a pH buffering component as an optional but preferred component. The pH buffering component ensures that the pH of the composition is buffered to a pH value ranging from 8 to 14, preferably from 8.5 to 14, more preferably from 9 to 13.5, and most preferably 9.5 to 13.5 after the composition has been diluted into 1 to 500 times its weight of water.

Suitable pH buffering components for use herein are selected from the group consisting of alkali metal salts of carbonates, polycarbonates, sesquicarbonates, silicates, polysilicates, boron salts, boric acid, phosphates, stannates, alluminates and mixtures thereof. The preferred alkali metal salts for use herein are sodium and potassium.

Suitable boron salts or mixtures thereof for use herein include alkali metal salts of borates and alkyl borates and mixtures thereof. Examples of boron salts include alkali metal salts of metaborate, tetraborate, octoborate, pentaborate, dodecaboron, borontrifluoride and alkyl borate containing from 1 to 12 carbon atoms, preferably from 1 to 4. Suitable alkyl borate includes methyl borate, ethyl borate and propyl borate. Particularly preferred boron salts herein are the alkali metal salts of metaborate, such as sodium metaborate, potassium metaborate, and the alkali metal salts of borate, such as sodium borate, or mixtures thereof. Boron salts like sodium metaborate and sodium tetraborate are commercially available from Borax and Societa Chimica Larderello under the name sodium metaborate and Borax®.

Particularly preferred pH buffering components are selected from the group consisting of sodium carbonate, sodium silicate, sodium borate, sodium metaborate and mixtures thereof.

The raw materials involved in the preparation of hypohalite bleaches usually contain by-products, e.g., calcium carbonate resulting in an amount of up to 0.4% by weight of by-product within the hypohalite composition. However, at such amount, the by-product will not have the buffering action defined above.

Hypohalite bleach-containing compositions herein will preferably contain an amount of pH buffering component of from 0.5% to 9% by weight, preferably from 0.5% to 5% by weight, and more preferably in an amount of from 0.6% to 3% by weight of the composition.

Process of Bleaching Fabrics.

In the present invention, the liquid bleaching composition of the present invention is used by applying the bleaching composition to the fabric to be treated.

The liquid bleaching compositions can be used per se in neat or in diluted form.

By "in diluted form", it is meant herein that the compositions for the bleaching of fabrics according to the present invention may be diluted with a solvent by the user, the preferred solvent is water. Such dilution may occur for instance in hand laundry applications as well as by other means such as in a washing machine. Said compositions may be used at a dilution level of up to 1500:1 (solvent:composition), preferably from 5:1 to 1000:1 and more preferably from 10:1 to 700:1 (solvent:composition).

By "in neat form", it is to be understood that the bleaching compositions are applied directly onto the fabrics to be treated without undergoing any dilution, i.e., the liquid compositions herein are applied onto the fabrics as described herein.

Fabrics to be treated herein include, but are not limited to, clothes, curtains, drapes, bed linens, bath linens, table cloths, sleeping bags, tents, upholstered furniture and the like, and/or carpets.

By "treating a fabric", it is meant herein cleaning said fabric as the compositions herein comprise a substantially linear nonionic surfactant and bleaching/disinfecting said fabric as the compositions of the present invention comprise a bleach.

In the process of treating (e.g., cleaning and/or bleaching) a fabric, a bleaching composition according to the present invention is contacted with the fabrics to be treated.

This can be done either in a so-called "pretreatment mode", where a bleaching composition, as defined herein, is applied neat onto said fabrics before the fabrics are rinsed, or washed, then rinsed, or in a "soaking mode" where a bleaching composition, as defined herein, is first diluted in an aqueous bath and the fabrics are immersed and soaked in the bath, before they are rinsed, or in a "through-the-wash mode", where a bleaching composition, as defined herein, is added in addition to a wash liquor formed by dissolution or dispersion of a typical laundry detergent, preferably in a washing machine. It is also essential in both cases, that the fabrics be rinsed after they have been contacted with said composition, before said composition has completely dried off.

More specifically, the process of bleaching fabrics according to the present invention preferably comprises the steps of first contacting said fabrics with a bleaching composition according to the present invention, then allowing said fabrics to remain in contact with said composition, for a period of time sufficient to bleach said fabrics, then rinsing said fabrics with water. If said fabrics are to be washed, i.e., with a conventional composition comprising at least one surface active agent, the washing of said fabrics with a detergent composition comprising at least one surface active agent may be conducted before the step of contacting said fabrics with said bleaching composition and/or in the step where said fabrics are contacted with said bleaching composition and/or after the step where said fabrics are contacted with the bleaching composition and before the rinsing step and/or after the rinsing step.

The bleaching composition may be used in dilute or neat form. Where it is used diluted, the bleaching composition should remain in contact with the fabric for typically 1 to 60 minutes, preferably 5 to 30 minutes. Whereas, when the bleaching composition is used in its neat form, it should remain in contact with the fabric for a much shorter time, typically 5 seconds to 30 minutes, preferably 1 minute to 10 minutes.

In an embodiment of the present invention wherein the liquid bleaching composition of the present invention, is contacted to the fabrics in its neat form and the bleach according to the present invention is a hypohalite 6leach, it is preferred that the level of said hypohalite bleach, is from 0.01% to 5%, preferably from 0.1% to 3.5%, more preferably from 0.2% to 2% and most preferably from 0.2% to 1%. Advantageously, the present invention provides liquid hypohalite bleach-containing compositions that may be applied neat onto a fabric to bleach.

It is preferred to perform the bleaching process herein before said fabrics are washed. Indeed, it has been observed that bleaching said fabrics with the compositions according to the present invention (diluted and/or neat bleaching processes) prior to washing them with a detergent composition provides superior whiteness and stain removal with less energy and detergent than if said fabrics are washed first, then bleached.

Alternatively instead of following the neat bleaching process as described above (pretreatment application) with a rinsing step and/or a conventional washing step with a liquid or powder conventional detergent, the bleaching pretreatment operation may also be followed by the diluted bleaching process as described above either in bucket (hand operation) or in a washing machine.

In another embodiment the present invention also encompasses a process of treating a hard-surface. In such a process the hard-surfaces to be treated is contacted with a composition, as defined herein. Thus, the present invention also encompasses a process of treating a hard-surface with a composition, as defined herein, wherein said process comprises the step of applying said composition to said hard-surface, preferably only soiled portions thereof, and optionally rinsing said hard-surface.

In the process of treating hard-surfaces according to the present invention the composition, as defined herein, may be applied to the surface to be treated in its neat form or in its diluted form. In the diluted form, the composition is preferably diluted with up to 200 times its weight of water, preferably 80 to 2 times its weight of water, and more preferably 60 to 2 times its weight of water.

When used as hard surfaces cleaners the compositions of the present invention are easy to rinse and provide good shine characteristics on the treated surfaces.

Depending on the end-use envisioned, the compositions herein can be packaged in a variety of containers including conventional bottles, bottles equipped with roll-on, sponge, brusher or sprayers.

EXAMPLES

The following examples will further illustrate the present invention. The compositions are made by combining the listed ingredients in the listed proportions (weight % unless otherwise specified). The following Examples are meant to exemplify compositions used in a process according to the present invention but are not necessarily used to limit or otherwise define the scope of the present invention. Furthermore, the compositions IX to XVI are comparative example compositions.

| Compositions | I | II | III | IV | V | VI | VII | VIII | IX | X | XI | XII | XIII | XIV | XV | XVI |
|---|---|---|---|---|---|---|---|---|---|---|---|---|---|---|---|---|
| Marlipal ® 24-7 | 7.0 | 5.0 | 3.0 | 2.0 | 6.0 | 5.0 | 3.0 | 7.0 | | | | | | | | |
| Marlipal ® 24-4 | — | 1.0 | 1.0 | 1.5 | — | 2.0 | 1.5 | — | | | | | | | | |
| Marlipal ® 24-2 | — | — | — | — | 1.0 | — | — | — | | | | | | | | |
| Dobano ® 23-3 | | | | | | | | | 1.0 | 2.0 | 1.0 | 2.0 | 2.0 | 1.0 | 2.0 | 1.0 |
| Dobanol ® 45-7 | | | | | | | | | 3.0 | 1.5 | 3.0 | 1.5 | — | 3.0 | 1.5 | 3.0 |
| Dobanol ® 91-8 | | | | | | | | | — | — | — | — | 1.0 | — | — | — |
| Dobanol ® 91-10 | | | | | | | | | — | — | — | — | 1.0 | — | — | — |
| Alkyl betaine | — | — | — | — | — | 2.5 | 2.5 | 1.5 | — | — | — | — | — | 2.5 | 2.5 | 1.5 |
| Hydrogen Peroxide | 7.0 | 7.0 | 8.0 | 9.0 | 7.0 | 7.0 | 8.0 | 7.0 | 7.0 | 7.0 | 8.0 | 9.0 | 7.0 | 7.0 | 8.0 | 6.0 |
| Water and minors | | | | | | | | | up to 100% | | | | | | | |

All examples have a pH of up to 9

Marlipal ® 24-7 is a linear C12/C14 EO7 nonionic surfactants commercially available from Condea.

Marlipal ® 24-4 is a linear C12/C14 EO4 nonionic surfactants commercially available from Condea.

Marlipal ® 24-2 is a linear C12/C14 EO2 nonionic surfactants commercially available from Condea.

Dobanol ® 23-3 is a mixed branched/linear C12-C13 EO3 nonionic surfactant commercially available from SHELL.

-continued

| Compositions | I | II | III | IV | V | VI | VII | VIII | IX | X | XI | XII | XIII | XIV | XV | XVI |
|---|---|---|---|---|---|---|---|---|---|---|---|---|---|---|---|---|

Dobanol ® 45-7 is a mixed branched/linear C14-C15 EO7 nonionic surfactant commercially available from SHELL.
Dobanol ® 91-8 is a mixed branched/linear C9-C11 EO8 nonionic surfactant commercially available from SHELL.
Dobanol ® 91-10 is a mixed branched/linear C9-C11 EO10 nonionic surfactant commercially available from SHELL.
Hydrogen Peroxide is commercially available from Ausimont.
Alkyl betaine is Lauryl di-methyl betaine commercially available by Hoechst under the trade name GENAGEN. LAB ®.

The compositions in Examples I–VIII are according to the present invention and show beaching and/or stain removal benefits when used to tresat fabrics according to the process of the present invention.

What is claimed is:

1. A liquid bleaching composition comprising a bleach and a substantially linear nonionic surfactant, whereby said substantially linear nonionic surfactant has the general formula: $R—(A)_x—(B)_y—(C)_z—O—R_1$ wherein: R is an even numbered $C_6$ to $C_{22}$ alkyl chain or a mixture thereof, containing at least 90% linear alkyl chains; A is an ethoxy unit; B is a butoxy unit; C is a propoxy unit: x, y and z are independent integers of from 0 to 20: the sum of x+y+z is at least 2: wherein when x is greater than or equal to 1, then y+z is equal to or greater than 1; and $R_1$ is Hydrogen, a $C_6$ to $C_{22}$ alkyl chain or a $C_6$ to $C_{28}$ alkyl benzene chain.

2. A bleaching composition according to claim 1 wherein said composition comprises from 0.01% to 30% by weight of the total composition of said substantially linear nonionic surfactant.

3. A bleaching composition according to claim 1 wherein R is an alkyl chain containing at last 95% linear alkyl chains.

4. A bleaching composition according to claim 1 wherein said composition further compises a co-surfactant.

5. A bleaching composition according to claim 1 wherein said bleach is a peroxygen bleach.

6. A bleaching composition according to claim 5 wherein said peroxygen bleach is selected from the group consisting of: hydrogen peroxide; water soluble sources of hydrogen peroxide; organic or inorganic peracids; hydroperoxides; and diacyl peroxides; and mixtures thereof.

7. A bleaching composition according to claim 6 wherein said peroxygen bleach is selected from the group consisting of hydrogen peroxide and diacyl peroxides and mixtures thereof.

8. A bleaching composition according to claim 5 wherein said composition comprises selected from 0.01% to 30% by weight of the total composition of said peroxygen bleach.

9. A bleaching composition according to claim, 5 wherein $R_1$ of said substantially linear nonionic surfactant is Hydrogen.

10. A bleaching composition according to claim 5 wherein said composition has a pH of from 1 to 9 and comprises an acidifying agent or a mixture thereof.

11. A bleaching composition according to claim 1 wherein said bleach is a hypohalite bleach.

12. A bleaching composition according to claim 11 wherein said hypohalite bleach is an alkali metal and/or alkaline earth metal hypochlorite selected from the group consisting of sodium; potassium, magnesium, lithium and calcium hypochlorites, and mixtures thereof.

13. A bleaching composition according to claim 11 wherein said hypohalite bleach, based on active halide, is present in an amount of from 0.01% to 20% by weight of the bleaching composition.

14. A bleaching composition according to claim 5 wherein $R_1$ of said substantially linear nonionic surfactant is a $C_6$ to $C_{22}$ alkyl chain or a $C_6$ to $C_{28}$ alkyl benzene chain.

15. A bleaching composition according to claim 11 wherein said composition has a pH of from 8 to 14 and comprises an alkalinity source.

16. A bleaching composition according to claim 11 where said composition further comprises a pH buffering component.

17. A bleaching composition according to claim 16 wherein said pH buffering component is selected from the group consisting of sodium carbonate, sodium silicates, a boron salt, and is present in an amount of from 0.5% to 9% by weight of the liquid composition.

18. A process of bleaching fabrics which comprises the step of contacting said fabrics with a bleaching composition according to claim 1, in its diluted form at a dilution level with water up to 1500 times.

19. A process of bleaching fabrics according to claim 18 which comprises the additional subsequent steps of:

allowing said fabrics to remain in contact with said bleaching composition for a period of time sufficient to bleach said fabrics, then rinsing said fabrics in water to remove said bleaching composition.

20. A process according to claim 18 wherein said fabrics are washed with a detergent composition comprising at least one surface active agent before and/or during the contacting with the bleaching composition and/or after the rinsing when said bleaching composition has been removed.

21. A process of bleaching a fabric which comprises the step of contacting said fabric with a liquid bleaching composition according to claim 1, in its neat form, allowing said fabric to remain in contact with said bleaching composition for a period of time sufficient to bleach said fabric, and then rinsing said fabric in water to remove said bleaching composition.

22. A process according to claim 21 wherein said fabric is washed with a detergent composition comprising at least one surface active agent before the step of contacting said fabric with said bleaching composition and/or after the step of rinsing wherein said bleaching composition has been removed.

* * * * *